United States Patent [19]

Borgerding et al.

[11] 4,215,004

[45] Jul. 29, 1980

[54] SLURRIED LAUNDRY DETERGENT

[75] Inventors: James F. Borgerding; Robert T. Claus, both of Cincinnati, Ohio

[73] Assignee: Chemed Corporation, Cincinnati, Ohio

[21] Appl. No.: 24,800

[22] Filed: Mar. 28, 1979

Related U.S. Application Data

[63] Continuation-in-part of Ser. No. 18,292, Mar. 6, 1979, abandoned.

[51] Int. Cl.[2] ..... C11D 7/06

[52] U.S. Cl. ..... 252/156; 252/135; 252/DIG. 3; 252/180; 252/534

[58] Field of Search ..... 252/156, 135, 534, DIG. 3, 252/180

[56] References Cited

U.S. PATENT DOCUMENTS

| | | | |
|---|---|---|---|
| 2,798,053 | 7/1957 | Brown | 252/139 UX |
| 4,147,650 | 4/1979 | Sabatelli et al. | 252/156 X |

OTHER PUBLICATIONS

"Carpopol 934," B. F. Goodrich, Mar. 1954.

*Primary Examiner*—Mayer Weinblatt
*Attorney, Agent, or Firm*—Charles L. Harness

[57] ABSTRACT

Heavy duty built laundry washing product in slurry form containing alkali metal hydroxide, detergents, sodium polyacrylate, a modified polyacrylic acid salt, and water insoluble aluminosilicate ion exchange material and/or complex phosphates; also optionally optical brightener, coloring agent, carboxymethyl cellulose and salts thereof, and perfume.

3 Claims, No Drawings

SLURRIED LAUNDRY DETERGENT

This is a continuation-in-part of our copending application Ser. No. 18,292, filed Mar. 6, 1979, now abandoned, the entire contents are herein incorporated by reference.

The invention is directed to a highly concentrated heavy duty built laundry washing product in a form amenable to mechanical metering (i.e., in slurry form), containing Na or K hydroxides, detergents, water-insoluble aluminosilicate ion exchange material, or sodium tripolyphosphate or mixtures thereof, sodium polyacrylate, a modified polyacrylic acid salt and water and optionally optical brightener, coloring agent, sodium carboxymethyl cellulose and perfume.

Both granular and liquid laundry products have a number of inherent deficiencies.

Granular products are subject to caking in their package or in the dispenser from which they are fed into the laundry machine. They contain bulk aids or fillers which serve no direct purpose in laundering fabric.

On the other hand, conventional liquid laundry washing products are limited in the amount of active ingredients which can be dissolved in water and still provide a stable system.

We have discovered that incorporating the best properties of the liquid laundry detergent and the granular laundry detergent into a single new laundry product was best achieved by using a novel blend in a slurry form.

The slurry form eliminates the caking and the dusting of powdered laundry detergents and provides a positive means of mechanically dispensing into the laundry machine. It also provides improved performance over liquid products, which are limited in concentration by the mutual compatibility of its ingredients. The use of a slurry allows the use of materials normally incompatible and/or insoluble since in a slurry, no true solution need be formed. Rather, a semi-fluid, essentially homogeneous mass is the only prerequisite for a satisfactory product.

Our new composition is particularly useful in areas where the water supply contains high calcium and magnesium hardness. Our product has high physical stability. Kept at 120° F. for two weeks it shows only very slight separation. It is easily metered using a peristaltic dispensing pump.

Table 1 gives preferred and operable ranges for the components. Most of the components are discussed further below, particularly as to their preferred forms.

Table 1

| Components | Preferred Formulation | Preferred Narrow Range, Wt. % | Preferred Broad Range, Wt. % |
|---|---|---|---|
| Water | 45.4 Wt. % | 45.0–73.0 | 25.0–80.0 |
| Modified polyacrylic acid thickening agent[1] | 0.5 Wt. % | 0.3–1.3 | 0.1–3.0 |
| Liquid caustic soda 50% active | 25.0 Wt. % | 11.0–39.0 | 5.0–50.0 |
| (Dry Basis) | (12.5) Wt. % | (5.5–19.5) | (2.5–25.0) |
| Brilliant alizarine milling blue BL | 14 g./1000 lbs | | |
| Non-ionic surfactant | 5.0 Wt. % | 2.0–8.0 | 0.0–12.0 |
| Polyphosphate | 16.0 Wt. % | 0.0–20.0 | 0.–30.0 |
| Sodium polyacrylate, 20% soln. in water | 6.0 Wt. % | 1.0–10.0 | 1.0–20.0 |
| (Dry Basis) | (1.2) Wt. % | (0.2–2.0) | (0.2–4.0) |
| Alkyl aryl sulfonic acid | 2.0 Wt. % | 0.0–4.0 | 0.0–10.0 |
| Optical brightener | 0.1 Wt. % | 0.05–1.0 | 0.–2.0 |
| Sodium aluminosilicate | — | 0.0–18.0 | 0.–30.0 |
| Sodium carboxymethylcellulose | — | 0.5–1.5 | 0.–2.0 |

[1]The thickening agent as broadly defined and as covered in "Preferred Broad Range" is dispersible cross-linked interpolymer of a monomeric mixture comprising a monomeric polymerizable alpha-beta monoolefinically unsaturated lower aliphatic carboxylic acid, and a polyether of a polyol selected from the class consisting of oligo saccharides, reduced derivatives thereof in which the carbonyl group is converted to an alcohol group, and pentaerythritol, the hydroxyl groups of said polyol which are modified being etherified with allyl groups, said polyol having at least two allyl ether groups per polyol molecule. As defined and covered in "Preferred Narrow Range" it is within the aforesaid definition, and further it is made by co-polymerizing about 98–99.5 parts by weight of acrylic acid with about 0.5–2.0 parts of polyallyl polyether of sucrose having about 2–8 allyl groups per molecule. As defined and covered in "Preferred Formulation" it is within the aforesaid definition and within the preceding statement of preparation, and further, it is made by co-polymerized about 98.75 parts by weight of acrylic acid with about 1.25 parts of polyallyl polyether of sucrose having about 5.6 allyl groups per molecule.

EXAMPLE 1

A slurried detergent was prepared as follows. The ingredients as given in Column 1 of Table 1 were added in order to a kettle equipped with a jacket capable of heating and cooling and a mixer capable of running at a minimum of 150 rpm. Sufficient ingredients were used to make a 1000 pound mix. The water was added first, at 50°–80° F. Next the modified polyacrylic acid was added, using a funnel disperser. This component was added slowly to avoid lumping. It was admixed into the water with high agitation until dissolved. The liquid caustic soda was added next and mixed for ten minutes. The alizarine blue dye was predissolved in three quarts of hot tap water and added to the batch. The ethoxylated alcohol detergent (non-ionic surfactant) was added slowly and mixed for ten minutes with maximum agitation. At this point water is run through the kettle jacket to provide cooling to 120° or less. The sodium tripolyphosphate was added slowly through a four-to-the-inch screen with the mixer going at the highest speed. A good rate of addition is five minutes per 100 pounds with a five-minute pause between each 100 pounds added. If the powder floats or otherwise does not mix or wet, allow more time between additions. The rate of addition of the sodium tripolyphosphate is very important for good mixing. After all of the sodium tripolyphosphate is added, mix one hour. The temperature is maintained at 120° F. or less after the addition of the sodium tripolyphosphate. At the end of that time pull a sample for inspection. The sample should flow like a lotion with no curding. If curding occurs, mix an additional hour and recheck. Continue mixing until smooth. Next add the sodium polyacrylate and mix for fifteen minutes. Next add the dodecyl benzene sulfonic acid and mix for fifteen minutes. Next add the sulfostyryl derivative and mix for one hour. This completes preparation of the composition.

In compositions that include sodium aluminosilicate and/or sodium carboxymethylcellulose, these should be stirred into the vessel in similar fashion, with a view to eliminating lumps and sediment.

This slurried laundry product uses a water softener system suspended in a base thickened with a modified polyacrylic acid salt and a polyacrylic acid salt. The modified polyacrylic acid salt and the polyacrylic acid salt act as suspending aids to keep the water softener (zeolite, sodium tripolyphosphate or a variety of other water softeners known to the trade) suspended uniformly for prolonged periods of storage.

EXAMPLE 2

In order to make modified polyacrylic acid polymers of the type of Example 1, solution polymerization using the following reaction mixture can be used:

| Raw Material | Parts by Weight |
|---|---|
| Acrylic acid | 98.75 |
| Polyallyl sucrose | 1.25 |
| Azoisobutyronitrile | 1.0 |
| Benzene | 880.0 |

The polymerization is carried out under autogenous pressure at 50° C. until the reaction is complete, which may require 20 hours. The polymer formed is a fine friable powder. The powder, freed from solvent, is in the acid form, and is ready to use. Molecular weight is about 1,000,000. Preferably the product is neutralized with alkali, e.g., NaOH or KOH, to develop its thickening properties in formulations. Such alkali is provided in the formulations in Table 1.

The polyallyl sucrose can be made by the allylation of sucrose. The sucrose is dissolved in concentrated aqueous sodium hydroxide solution, one and one-half equivalent weights of allyl chloride for every hydroxyl group in the sucrose molecule added and the mixture sealed in a reaction autoclave. The autoclave and its contents are heated to 80° to 83° C. for about five hours until no further drop in pressure occurs. The autoclave is cooled and the contents diluted with water until all precipitated salts are dissolved. An organic layer separates out and is isolated and steam distilled. The crude product resulting from steam distillation is then washed with a large volume of water. The wet polyallyl sucrose is then dissolved in toluene, decolorized with "Darco" activated charcoal and dried with sodium sulfate. The toluene is finally removed by distillation under reduced pressure at 100° C. The residue remaining is a polyallyl polyether of sucrose. It has an average of 5.6 allyl groups and 1.97 hydroxyl groups per molecule. The yield is about 91%.

The polymers formed from the reaction of polyallyl sucrose and acrylic acid as in Example 5 of U.S. Pat. No. 2,798,053 are suitable as the allyl sucrose modified polyacrylic acid component of our composition. That patent is incorporated herein by reference in its entirety. Similar procedures for making the same or substantially the same acrylic-allyl sucrose copolymers are given in U.S. Pat. No. 4,130,501. That patent is likewise incorporated herein by reference in its entirety. Carbopol 941, a modified polyacrylic acid available commercially from B. F. Goodrich, is considered similar to that of Example 2 of or instant specification and is especially suitable.

The above procedure (our Example 2) gives a polyacrylic acid modified by slight cross-linking with polyallyl sucrose. The molecular weight is about 500,000–10,000,000, typically 1,000,000. This material is herein referred to as allyl sucrose modified polyacrylic acid or (for purposes of brevity, e.g., in Table 1) simply modified polyacrylic thickening agent.

More comprehensively stated, the modified polyacrylic acid thickening agent can operably be the genus defined as a water dispersible copolymer of an alpha-beta monoolefinically unsaturated lower aliphatic carboxylic acid crosslinked with a polyether of a polyol selected from the class consisting of oligo saccharides, reduced derivatives thereof in which the carbonyl group is converted to an alcohol group, and pentaerythritol, the hydroxyl groups of said polyol which are modified being etherified with allyl groups, said polyol having at least two allyl groups per polyol molecule, water dispersions of which are suitable for use as suspension aids by adjusting the pH to the proper range. Examples of commercially available members of this class of resin are the Carbopol resins, i.e., Carbopol 934, Carbopol 940 and Carbopol 941, manufactured by B. F. Goodrich Chemical Company, Akron, Ohio. Particularly preferred is Carbopol 941. The Carbopol resins can be made by the process of U.S. Pat. No. 2,798,053, above referenced.

Some of the other components of our composition are herein described as follows.

The non-ionic surfactant is preferably the reaction product of a linear $C_{12}$–$C_{15}$ alcohol with 3–12 moles of ethylene oxide. The 7 mole ethoxylate is preferred. Other nonionic detergents or mixtures thereof known to the trade are also suitably incorporated.

Sodium polyacrylate can have a molecular weight in the range 50,000–200,000. Typically the molecular weight is about 90,000. It is available as PSK-20 from Dearborn Div., Chemed Corp. (Molecular weights herein given are weight average unless otherwise stated.) The sodium polyacrylate is preferably added in liquid form in solution, e.g., in water. We prefer a 20% solution in water. Other monovalent polyacrylic acid salts are also suitable, as are monovalent polymethacrylic acid salts.

The alkyl aryl sulfonic acid and salts thereof are well known surfactant detergents and are available commercially as compounds of the formula alkyl

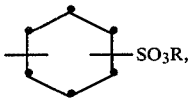

where the alkyl group is $C_8$–$C_{18}$ and R is Na, K, or H. The preferred product is linear dodecylbenzene sulfonic acid. Other anionic detergents or mixtures thereof known to the trade are also suitably incorporated.

The optical brightener or whitener is suitably 4,4'-di(2-sulfostyryl biphenyl), disodium salt, available commercially as Tinopal CBS from Ciba-Geigy Corp. Numerous other suitable optical brighteners are commercially available, and the type is not critical, except that it be chemically stable in the medium of the composition. A typical optical brightener for laundry use is made by diazotization of 4-aminostilbene-2-sulfonic acid, followed by coupling with e.g., a naphthylamine derivative, and oxidation to the triazole compound.

The zeolite, a sodium aluminosilicate of the formula $Na_{12}[(AlO_2)_{12}(SiO_2)_{12}]\cdot XH_2O$, is available commercially as zeolite 4A from various sources, e.g., as Sylosiv 100 from W. R. Grace & Co. with X=0–2, typically 1 or 2. When it is put in water, it rapidly hydrates until X=about 20–30. Hence, operationally, X=0–30.

As for the polyphosphate, there are several well-known polyphosphates useful as builders in laundry operations, e.g., the alkali metal pyrophosphates, sodium hexametaphosphate, sodium tripolyphosphate, and the like. These are also known as complexing or condensed phosphates. When we use a polyphosphate, we prefer sodium tripolyphosphate, in powdered form.

We claim:

1. A slurry detergent consisting essentially of:

| Components | Wt. % |
|---|---|
| Water | 45.0–73 |
| Water dispersible cross-linked interpolymer of a monomeric mixture consisting essentially of a monomeric polymerizable alpha-beta monoolefinically unsaturated lower aliphatic carboxylic acid, and a polyether of a polyol selected from the class consisting of oligo saccharides, reduced derivatives thereof in which the carbonyl group is converted to an alcohol group, and pentaerythritol, the hydroxyl groups of said polyol which are modified being etherified with allyl groups, said polyol having at least two allyl ether groups per polyol molecule | 0.3–1.3 |
| NaOH or KOH, dry basis | 5.5–19.5 |
| Non-ionic surfactant | 2.0–8.0 |
| Polyphosphate selected from the group consisting of alkali metal pyrophosphates, sodium hexametaphosphate, and sodium tripolyphosphate | 0.0–20.0 |
| Sodium polyacrylate, dry basis | 0.2–2.0 |
| Alkyl aryl sulfonic acid | 0.5–4.0 |
| Optical brightener | 0.0–0.35 |
| Sodium aluminosilicate | 0.0–25.0 |
| Sodium carboxymethylcellulose | 0.0–1.5 |

2. Slurry detergent according to claim 1 consisting essentially of:

| Components | Wt. % |
|---|---|
| Water | 45.0–73.00 |
| Allyl sucrose modified polyacrylic acid made by co-polymerizing about 98–99.5 parts by weight of acrylic acid with about 0.5–2.0 parts of polyallyl polyether of sucrose having about 4–8 allyl groups per molecule | 0.3–1.3 |
| Liquid caustic soda 50% active | 11.0–39.0 |
| (Dry Basis) | (5.5–19.5) |
| Ethoxylated alcohol surfactant, 3–10 moles ethylene oxide per mole of primary saturated $C_{12}$–$C_{15}$ alcohols | 2.0–8.0 |
| Sodium tripolyphosphate, powdered | 0.0–20.0 |
| Sodium polyacrylate, 20% soln. in water | 1.0–10.0 |
| Linear dodecyl benzene sulfonic acid | 0.0–4.0 |
| 4,4'-di(2-sulfostyryl-biphenyl, disodium salt | 0.05–1.00 |
| Sodium aluminosilicate, $Na_{12}[AlO_2)_{12}(SiO_2)_{12}]$. $XH_2O$, where x = about 0–30 | 0.0–18.0 |
| Sodium carboxymethylcellulose | 0.5–1.5 |

3. Slurry detergent according to claim 1 consisting essentially of:

| Components | Amount |
|---|---|
| Water | 45.4 Wt. % |
| Allyl sucrose modified polyacrylic acid made by co-polymerizing about 98.75 parts by weight of acrylic acid with about 1.25 parts by poly allyl polyether of sucrose having about 5.6 allyl groups per molecule | 0.5 Wt. % |
| Liquid caustic soda 50% active | 25.0 Wt. % |
| Brilliant alizarine milling blue BL | 15 g./1000 lbs. of formula |
| Ethoxylated alcohol detergent, 7 moles ethylene oxide per mole of primary saturated $C_{12}$–$C_{15}$ alcohols | 5.0 Wt. % |
| Sodium tripolyphosphate, powdered | 16.0 Wt. % |
| Sodium polyacrylate, 20% soln. in water | 6.0 Wt. % |
| Linear dodecyl benzene sulfonic acid | 2.0 Wt. % |
| 4,4'-di(2-sulfostyryl-biphenyl), disodium salt | 0.1 Wt. % |

* * * * *